United States Patent [19]

Siebert

[11] Patent Number: 4,603,545

[45] Date of Patent: Aug. 5, 1986

[54] YARN TWISTING AND WINDING APPARATUS

[75] Inventor: Georg Siebert, Hückeswagen, Fed. Rep. of Germany

[73] Assignee: Artec Design GmbH, Fed. Rep. of Germany

[21] Appl. No.: 765,707

[22] Filed: Aug. 14, 1985

[30] Foreign Application Priority Data

Aug. 16, 1984 [DE] Fed. Rep. of Germany ..... 3430046
Jul. 20, 1985 [DE] Fed. Rep. of Germany ..... 3525996

[51] Int. Cl.[4] ..... B65H 54/66; D01H 7/50

[52] U.S. Cl. ..... 57/68; 57/67; 242/2

[58] Field of Search ..... 57/66, 67, 68; 242/2, 242/247, 159, 174

[56] References Cited

U.S. PATENT DOCUMENTS 1,409,671 3/1922 Clauss ..... 242/2
2,352,737 7/1944 Roosa ..... 242/2
2,518,967 8/1950 Witt ..... 242/2 X
3,309,185 3/1967 Weber ..... 242/2 X
4,107,912 8/1978 Pockman et al. ..... 57/68

FOREIGN PATENT DOCUMENTS 119588 3/1945 Australia ..... 242/2

*Primary Examiner*—Donald Watkins
*Attorney, Agent, or Firm*—Bell, Seltzer, Park & Gibson

[57] ABSTRACT

A yarn twisting and winding apparatus is disclosed which is adapted to produce a yarn ball, and which includes a yarn support spindle (12) and surrounding flyer (19). The flyer is rotatable about a central axis (15), and the yarn support spindle is mounted so that its axis (12') intersects the central axis. Also, the spindle (12) is rotated about the central axis (15), as well as its own axis (12') during the winding operation. A yarn delivery roll (4) is mounted coaxially about the central axis, and so that the yarn is adapted to advance to the flyer, around the yarn delivery roll, back to the flyer, and then to the yarn support spindle to form a yarn ball.

22 Claims, 5 Drawing Figures

YARN TWISTING AND WINDING APPARATUS

Figure 1:
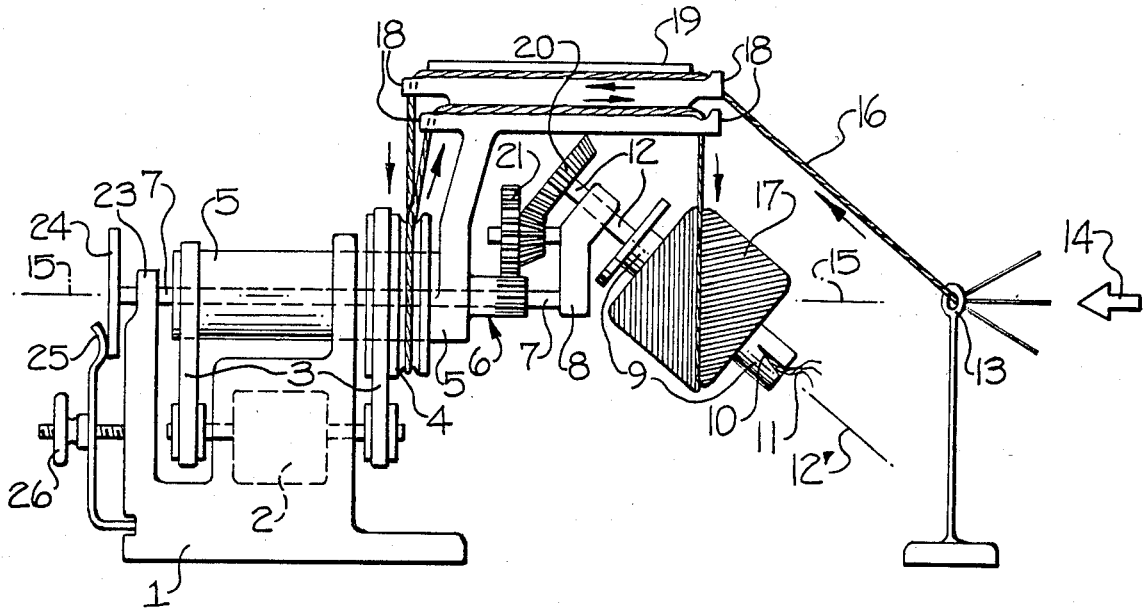

The present invention relates to a yarn twisting and winding apparatus, of the type commonly described as a flyer twisting machine. A flyer twisting machine of this general type is described for example in "Melliand Textilberichte" (Textile Reports), 1975, volume 6, page 431, in connection with picture 3, FIG. 2.

Flyer twisting machines of conventional design are adapted to twist a yarn, or to simultaneously ply and twist several yarns, and the resulting yarn is then wound on a bobbin core. The resulting bobbins are then further processed on other machines. However, in the home work industry, such as the manufacture of hand crafted articles composed of wool, cotton, etc., there is a demand for the ability to twist and/or ply yarns according to the operator's own desire, and in doing so, for effecting a takeup of the yarns such that it is in the form of a ball suitable for the home work industry.

It is accordingly an object of the present invention to produce a flyer twisting machine which is designed and constructed so that it is able to produce yarn balls suitable for the home work industry, and which also combines the presently employed multi-step operations of plying, twisting, winding and rewinding to a ball into a single operation.

These and other objects and advantages of the present invention are achieved in the embodiments herein by the provision of a yarn twisting and winding apparatus which includes yarn takeup means comprising a yarn support spindle which defines a spindle axis, a yarn twisting flyer mounted for rotation about the yarn support spindle and so as to define a central axis, and flyer drive means for rotating the flyer about the central axis. In accordance with the present invention, the yarn takeup means includes means mounting the yarn support spindle such that the spindle axis is angularly disposed with respect to the central axis, and such that the yarn support spindle is rotatable about both the central axis and the spindle axis. Drive transmission means is also provided which is operatively connected to the flyer drive means for concurrently rotating the spindle about the central axis and the spindle axis. Preferably, means are also provided for twisting a yarn by a yarn twisting flyer at a predetermined controlled rate of twist (turns per meter).

In a preferred embodiment, the apparatus further comprises a yarn delivery roll mounted coaxially about the central axis, and yarn guide means mounted on the flyer such that the yarn is adapted to be guided to the flyer, then looped about the delivery roll and guided back to the flyer, and finally guided to the yarn support spindle upon which the ball is formed.

The apparatus of the present invention is suitable for economically producing small amounts of twisted yarns, as for example may be needed in private households, hobby and handicraft stores, schools, and the like. The makeup of the yarn in the form of a ball, which is preferred by the end user for knitting, crocheting, or weaving, may thus be done directly by the user, and may in addition be done in accordance with the wishes and needs of the user. Spinning wheels or similar devices have heretofore been used to adapt the yarns to a quantatatively limited, and individually directed use. However, it has not heretofore been possible to directly produce yarn balls, as a rewinding operation has been required.

With the present invention, small amounts of high quality twists can be produced, since the invention enables a constant twisting ratio of turns per meter, in that the twisting flyer is preferably coupled with the yarn conveying mechanism, i.e., the yarn delivery roll. Thus the invention combines the principle of a flyer twisting machine with ball winding, and wherein the spindle axis for the ball is arranged obliquely to the flyer central axis. Also, it is preferable that the center of gravity of the ball which is wound on the spindle should be positioned on the central axis of the flyer, so as to avoid imbalances during the winding operation. The means for mounting the spindle permits the spindle to rotate relative to the twisting flyer, but with a braking force applied thereto.

In the preferred embodiment, the means mounting the yarn support spindle comprises a shaft mounted for rotation about the central axis, and an arm extending radially from the shaft, and with the arm rotatably mounting the yarn support spindle. The braking force is applied to the spindle mounting means by means of a friction wheel which is provided at one end of the shaft, with the wheel being in contact with a stationary brake shoe having an adjustable spring tension. A yarn displacement system is thereby provided, in that the ball is rotated relatively slowly about its axis. As a result, one yarn winding on the ball comes to lie substantially next to the other. The displacement drive is transmitted via a flyer drive whorl which is mounted for rotation about the flyer central axis, and which includes a sun gear which is operatively connected to a drive gear mounted on the yarn support spindle. Intermediate gearing for operatively interconnecting the sun gear and the drive gear is supported on a radial arm which is fixed at one end of the shaft of the spindle mounting means. The sun gear and intermediate gears may take the form of friction wheels, gears, worm gears, as well as belt drives.

In a preferred embodiment, the mountings of the flyer drive whorl and of the means mounting the support spindle are arranged on the side of the yarn ball which is opposite from the path of the advancing yarn. As a result, the ball is easily accessible, which is particularly important in private operation and where small quantities of twisted yarns are produced. It is also advantageous to have the yarn conveying means, specifically the yarn delivery roll, mounted concentrically about the flyer drive whorl, and preferably rotatably supported on the drive whorl. In such case, the yarn delivery roll may have a drive which is separate from that of the drive whorl.

In one specific embodiment, the yarn delivery roll and the flyer drive whorl are driven by a common drive motor. As a result, twisted yarns are produced which have a uniform twist ratio. However, for the production of effect yarns, it is also possible to drive the yarn delivery roll at varying speeds, whereby the twist ratio changes over the yarn length. Alternatively, a separate drive may be provided for the yarn delivery roll, which can be adjusted independently of the drive for the flyer drive whorl.

In still another embodiment, the yarn delivery roll is supported for free rotation on the flyer drive whorl, and the delivery roll is adapted to be braked by an adjustable braking force. Here again, a constant twist can be achieved in that the difference in speed between that of the yarn delivery roll and drive whorl may be continuously monitored, and maintained constant by means of a regulator which controls the braking force applied to the delivery roll.

With respect to the mounting of the yarn delivery roll, the present invention provides for a unique yarn guidance, which also serves to facilitate the accessibility of the yarn support spindle and yarn ball. To this end, the yarn is adapted to be advanced from a yarn delivery guide mounted on the central axis of the flyer, and guided initially along the twisting flyer to the opposite end. The yarn thereafter is looped over the delivery roll, for example forming half a loop, and is returned to and guided along the twisting flyer to the area of the ball winding. There, the yarn leaves the twisting flyer and advances toward the periphery of the ball.

The twisting flyer may be in the form of a cupshaped pot, which serves to reduce the air resistance and air noises. In such case, it is possible to deflect the yarn on the twisting flyer in a zig-zag form, so as to thereby effect a twist accumulation. As a result, the yarn initially receives more twists per unit of length as it passes along the twisting flyer, than when it is wound on the ball. Thus the yarn is over twisted before it is wound on the ball, and is substantially torque free when wound on the ball so that it no longer exhibits a tendency to curl when being processed.

Figure 2:
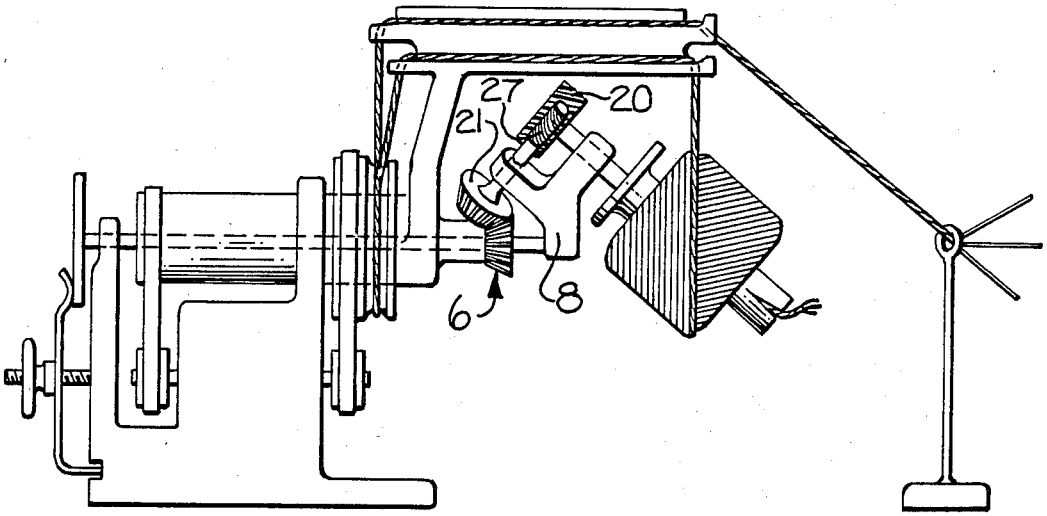
Figure 3:
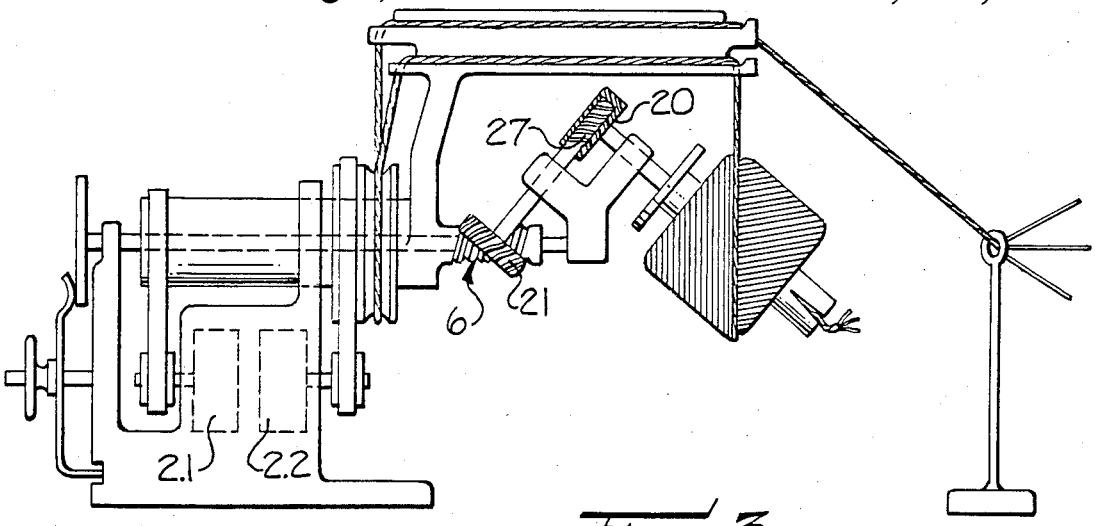
Figure 4:
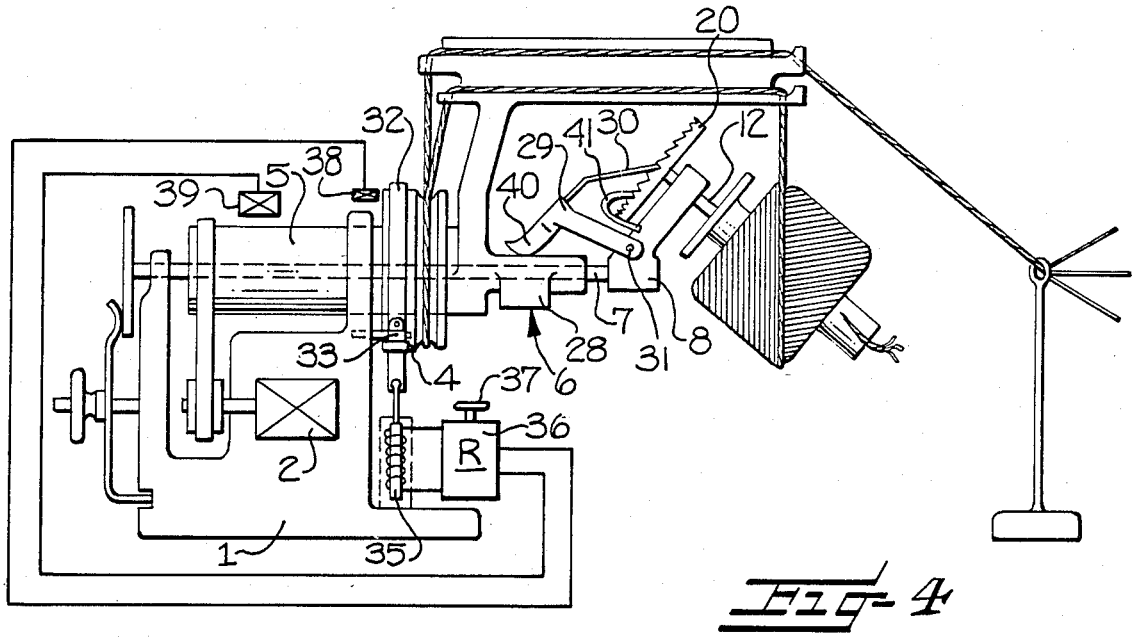
Figure 4A:
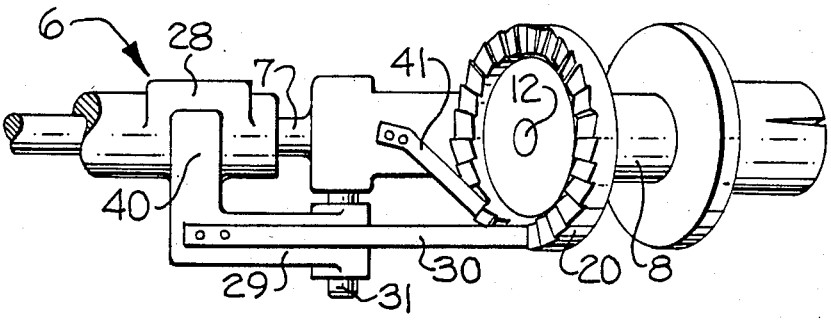

Some of the objects and advantages of the present invention having been stated, others will appear as the description proceeds, when taken in conjunction with the accompanying drawings, in which:

FIG. 1 is a schematic side elevation view of a twisting and winding apparatus which embodies the features of the present invention;

FIGS. 2, 3, and 4 are views similar to FIG. 1, but illustrating further embodiments of the present invention; and FIG. 4A is a fragmentary perspective view of a portion of the apparatus shown in the embodiment of FIG. 4.

Referring more particularly to the drawings, FIG. 1 schematically illustrates a yarn twisting and winding apparatus which is adapted to produce a yarn ball in accordance with the present invention. More particularly, the apparatus comprises a frame 1 which mounts a drive motor 2. The motor 2 drives one belt 3 which is connected to a yarn delivery roll 4, as well as a second drive belt 3 which is connected to a flyer drive whorl 5. The drive whorl 5 is mounted in a bearing 22 on the frame 1, and rotates about the axis 15, which is referred to herein as the central axis. The yarn delivery roll 4 is rotatable on the flyer drive whorl 5. A twisting flyer 19 is mounted to the drive whorl 5, so as to also rotate about the central axis 15.

The yarn takeup means of the apparatus comprises a yarn support spindle 12, which defines a spindle axis 12'. The spindle axis 12' forms an angle with the central axis 15, and the spindle axis 12' may intersect the central axis although functionally it does not need to. The takeup means also includes a shaft 7 mounted for rotation about the central axis 15, and an arm 8 extending radially from the shaft, and with the arm rotatably mounting the spindle 12. The drive whorl 5 is in the form of a hollow tube, and the shaft 7 extends coaxially therethrough, but is independent of the rotation of the drive whorl 5. The shaft 7 is also rotatably mounted in a bearing 23 on the frame 1. Also, the left end of the shaft 1 as seen in FIG. 1 includes a friction wheel 24, and a resilient brake shoe 25 is biased against the wheel 24 by a brake adjusting assembly 26 for applying an adjustable braking force to the shaft 7 so as to brake and slow down the rotation thereof about the central axis.

The spindle 12 mounts a winding core 9 upon which a yarn ball 17 is adapted to be formed, and the core 9 includes a notch 10 for receiving the yarn end 11. Also, the spindle 12 and the core 9 are brought to a slow rotation by a drive transmission means which is operatively connected to the flyer drive means, and such that the spindle 12 and core 9 are concurrently rotated about the central axis 15 and the spindle axis 12', while the twisting flyer 19 rotates about the spindle 12 and the ball 17 formed thereon. This drive transmission means includes a sun gear 6 which is coaxially fixed to the drive whorl 5, and a drive gear 20 which is coaxially fixed to the spindle 12. The sun gear 6 and the drive gear 20 are operatively interconnected by means of an intermediate planetary gear 21 which is mounted to the radial arm 8.

In the illustrated embodiment, the twisting flyer 19 comprises a yarn guiding portion generally extending parallel to the central axis and revolving around the yarn ball 17 on a cylindrical orbit. For permitting a clear view of the ball spindle and spindle drive, the drawings show a rod-shaped flyer 19. It should, however, be noted that other configurations are suitable such as a pot-shaped flyer having free access from the top to the ball and to the spindle and being connected at its bottom to the flyer drive whorl.

The embodiment of FIG. 2 differs from that of FIG. 1 in that the means operatively interconnecting the sun gear 6 and the drive gear 20 is in the form of a worm gear 21,27, which is provided so as to obtain the necessary speed reduction. In the embodiment of FIG. 3, the sun gear 6 is a worm thread, and rotation is transmitted by another worm 27 to the correspondingly designed drive gear 20 which is fixed to the yarn support spindle. The embodiment of FIG. 3 further differs from those of FIGS. 1 and 2, in that separate drive motors 2.1 and 2.2 are provided for the drive whorl 5 and yarn delivery roll 4, respectively. Thus the two drives are independent of each other, and both motors may be operated at a constant speed, i.e., synchronously. A variable speed ratio of the two motors permits yarns having respectively different twist ratios, i.e. turns per meter, to be produced. However, it is also possible to continuously vary the speed ratio of these motors in the winding of a ball periodically or aperiodically, so as to produce effect yarns having twists which differ over the yarn length. Alternatively, the speed ratio may be varied with the use of only one motor 2, with suitable control gearing.

In the embodiment of FIGS. 4 and 4A, the drive whorl 5 is driven by the motor 2. The motor 2 and drive whorl are mounted on the frame 1, and the shaft 7 extends through the drive whorl in a coaxial relationship and includes a radial arm 8 similar to that described above with respect to the earlier embodiments. The yarn support spindle 12 is rotatably supported in the arm 8, and is driven by a drive gear 20. This drive system proceeds from the sun gear 6, which is an integral part of the drive whorl 5, as further described below. The yarn delivery roll 4 is mounted on the drive whorl 5 so as to permit free relative rotation therebetween. The roll 4 is adapted to be braked by a belt 32 which is firmly held at one end 33, and which is attached to a electromagnet 35 at its other end. The electromagnet 35 receives its current from a regulator 36 which has an input 37 for the nominal value representing the twist level i.e. turns per meter of yarn length, to be adjusted. The nominal value is related by the regulator to the actual difference in the rotational speed of the delivery roll 4 and the drive whorl 5. This difference represents the actual twist level. For this purpose a speedometer 38 is provided for the roll 4, and a speedometer 39 is provided for the drive whorl 5. The output signals from the two speedometers are supplied to the regulator, which then determines the differential value. The regulator compares this actual differential value with the nominal value and adjusts the output signal to the electromagnet 35 in such a way that there is no difference between the nominal and the actual differential value.

The embodiment of FIG. 4 further distinguishes itself by the specific means for interconnecting the sun gear 6 and the drive gear 20. In this instance, the sun gear 6 is in the form of an eccentric cam 28, and a pawl and ratchet assembly is mounted to the radial arm 8 and includes a ratchet 29 pivotally mounted to the arm at pivot 31. The ratchet 29 includes a follower 40 at one end which is adapted to contact the cam 28, and a leaf spring 30 at the other end which engages the teeth of the drive gear 20. The periodic movement of the eccentric cam resulting from the rotation of the drive whorl 5 is transmitted to the follower 40 of the ratchet 29, which in turn causes the leaf spring 30 to advance the gear 20. A pawl is indicated at 41, which serves to prevent the drive gear 20 from rotating in the reverse direction when the ratchet 29 performs its returning motion by reason of a spring (not shown) which is located at the pivot 31.

In all of the described embodiments, a yarn 16 is shown to be produced from three separate components which advance to a fixed yarn guide 13 in the direction 14. To this end, the yarn 16 is first guided into a yarn guide 18 on the twisting flyer 19, and the yarn then advances to the opposite end of the flyer and then to the yarn delivery roll 4. The yarn loops around the roll 4 and then returns to the twisting flyer 19, which has one or more yarn guides 18 for this purpose. Upon leaving the flyer 19, the yarn advances to the ball 17. As previously described, the ball 17 is brought to a slow rotation by its mounting means, and by reason of the fact that the axis 12' of the ball is arranged obliquely to and intersects the axis of rotation 15 of the flyer 19, the slow rotation of the ball 17 results in the contact point of the yarn on the ball continuously changing.

A further aspect of the present invention is the fact that the yarn 16 does not directly advance from the flyer 19 to the ball 17. Rather, the yarn is first guided to the flyer 19, then withdrawn by a driven yarn delivery roll 4 which is concentric to the axis 15, and which has a controlled speed. The yarn loops around the roll 4 and then returns to and passes along the twisting flyer 19, and from there it advances to the ball 17. As illustrated in all of the embodiments, the strands of yarn which advance to the yarn delivery roll 4 and then leave the same, are guided on the flyer 19 in a parallel and closely spaced apart relationship. However, this arrangement is not necessary, and it is possible and practical, to provide two twisting flyers opposite to each other so as to avoid imbalances. The yarn is then able to advance from one twisting flyer to the delivery roll 4, embrace the delivery roll either partly or one or more times, and upon leaving the roll 4 advance to the other flyer. Similarly, the twisting flyer may be in the form of a cup-shaped pot, with the advance travel of the yarn to the delivery roll 4 occurring along either the same surface line, or a surface line which is different from the return travel from the delivery roll.

In the drawings and specification, there has been set forth a preferred embodiment of the invention, and although specific terms are employed, they are used in a generic and descriptive sense only and not for purposes of limitation.

That which is claimed is:

1. A yarn twisting and winding apparatus adapted to produce a yarn ball, and which includes yarn takeup means comprising a yarn support spindle (12) which defines a spindle axis (12'), a yarn twisting flyer (19) mounted for rotation about said yarn support spindle and so as to define a central axis (15), and flyer drive means (2,3,5) for rotating said flyer about said central axis, characterized in that said yarn takeup means includes means (7,8) mounting said yarn support spindle such that said spindle axis is angularly disposed with respect to said central axis and such that said yarn support spindle is rotatable about both said central axis and said spindle axis, and drive transmission means (20,21,29) operatively connected to said flyer drive means for concurrently rotating said yarn support spindle about said central axis and said spindle axis.

2. The apparatus as defined in claim 1 wherein said means mounting said yarn support spindle comprises a shaft (7) mounted for rotation about said central axis, and an arm (8) extending radially from said shaft, and with said arm rotatably mounting said yarn support spindle.

3. The apparatus as defined in claim 2 wherein said drive transmission means includes means (24,25) for applying an adjustable braking force to said shaft (7) so as to resist the rotation thereof about said central axis.

4. The apparatus as defined in claim 3 wherein said flyer drive means comprises a drive whorl (5) mounted for rotation about said central axis, and a sun gear (6) coaxially fixed to said drive whorl.

5. The apparatus as defined in claim 4 wherein said drive transmission means further includes a drive gear (20) coaxially fixed to said spindle, and coupling means (21,29) operatively interconnecting said sun gear (6) and said drive gear (20).

6. The apparatus as defined in claim 5 wherein said coupling means includes an intermediate planetary gear (21) mounted to said radial arm (8).

7. The apparatus as defined in claim 5 wherein said coupling means includes a pawl and ratchet assembly (29,41) mounted to said radial arm (8).

8. The apparatus as defined in claim 7 wherein said sun gear is in the form of an eccentric cam (28), and said pawl and ratchet assembly includes a ratchet (29) pivotally mounted to said radial arm and contacting said eccentric cam for transmitting the periodic movement of said eccentric cam to said drive gear (20).

9. A yarn twisting and winding apparatus adapted to produce a yarn ball, and which includes yarn takeup means comprising a yarn support spindle (12) which defines a spindle axis (12'), a yarn twisting flyer (19) mounted for rotation about said yarn support spindle and so as to define a central axis (15), and flyer drive means (2,3,5) for rotating said flyer about said central axis, characterized in that said yarn takeup means includes means (7,8) mounting said yarn support spindle such that said spindle axis is angularly disposed with respect to said central axis and such that said yarn support spindle is rotatable about both said central axis and said spindle axis, and drive transmission means (20,21,29) operatively connected to said flyer drive means for concurrently rotating said yarn support spindle about said central axis and said spindle axis, and wherein said apparatus further comprises a yarn delivery roll (4) mounted coaxially about said central axis, and yarn guide means (18) mounted on said flyer such that a yarn is adapted to be guided to said flyer, then looped about said delivery roll and guided back to said flyer, and then guided to said yarn support spindle.

10. The apparatus as defined in claim 9 wherein said flyer drive means includes a drive whorl (5) mounted coaxially about said central axis, and said yarn delivery roll is rotatably supported upon said drive whorl, and such that the yarn delivery roll is rotatable with respect to said drive whorl.

11. The apparatus as defined in claim 10 further comprising means for rotatably driving said yarn delivery roll.

12. The apparatus as defined in claim 11 wherein said flyer drive means and said means for rotatably driving said yarn delivery roll include a common drive motor (2).

13. The apparatus as defined in claim 11 wherein said means for rotatably driving said yarn delivery roll includes a drive motor (2.2) which is separate from said flyer drive means.

14. The apparatus as defined in claim 10 further comprising means (32,33,35–39) for monitoring and controlling the relative rotational speed between said yarn delivery roll and said drive whorl.

15. The apparatus as defined in claim 14 wherein said means for monitoring and controlling the relative rotational speed includes means (32) for adjustably braking the rotation of said yarn delivery roll.

16. The apparatus as defined in claim 10 wherein said drive whorl (5) is in the form of a hollow tube, and wherein said means mounting said yarn support spindle includes a shaft (7) which extends coaxially through said drive whorl, and an arm (8) extending radially from said shaft, and with said arm rotatably mounting said yarn support spindle.

17. The apparatus as defined in claim 16 wherein said drive transmission means includes means (24,25) for applying an adjustable braking force to said shaft (7) so as to resist the rotation thereof about said central axis.

18. The apparatus as defined in claim 17 wherein said flyer drive means further includes a sun gear (6) coaxially fixed to said drive whorl (5), and wherein said drive transmission means further includes a drive gear (20) coaxially fixed to said spindle, and coupling means (21,29) mounted to said arm (8) and operatively interconnecting said sun gear (6) and drive gear (20).

19. A yarn twisting and winding apparatus which includes yarn takeup means comprising a yarn support spindle (12) which defines a spindle axis (12′), a yarn twisting flyer (19) mounted for rotation about said yarn support spindle and so as to define a central axis (15), and flyer drive means (2,3,5) for rotating said flyer about said central axis, characterized in that said yarn support spindle is rotatable about said central axis and drive means are operatively connected to said flyer means for concurrently rotating said flyer about said central axis, and wherein said apparatus further comprises a yarn delivery roll (4) mounted coaxially about said central axis, and yarn guide means (18) mounted on said flyer such that a yarn is adapted to be guided to said flyer, then looped about said delivery roll and guided back to said flyer, and then guided to said yarn support spindle, and means for maintaining a predetermined ratio between the rotational speed of said flyer and said delivery roll.

20. The apparatus as defined in claim 19 wherein said flyer drive means includes a drive whorl (5) mounted coaxially about said central axis, and said yarn delivery roll is rotatably supported upon said drive whorl, and such that the yarn delivery roll is rotatable with respect to said drive whorl, and means for rotatably driving said yarn delivery roll.

21. The apparatus as defined in claim 20 wherein said flyer drive means and said means for rotatably driving said yarn delivery roll include a common drive motor (2).

22. The apparatus as defined in claim 19 wherein said means for maintaining a predetermined ratio between the rotational speed of said flyer and said delivery roll comprises means (32,33,35–39) for monitoring and adjustably controlling the relative rotational speed between said yarn delivery roll and said flyer.

* * * * *